US012092426B2

(12) United States Patent
Tsuda

(10) Patent No.: US 12,092,426 B2
(45) Date of Patent: Sep. 17, 2024

(54) CAPTURE DEVICE

(71) Applicant: ON CO., LTD., Tokyo (JP)

(72) Inventor: Kuninori Tsuda, Tokyo (JP)

(73) Assignee: ON CO., LTD., Tokyo (JP)

( * ) Notice: Subject to any disclaimer, the term of this patent is extended or adjusted under 35 U.S.C. 154(b) by 0 days.

(21) Appl. No.: 18/025,770

(22) PCT Filed: Jul. 21, 2021

(86) PCT No.: PCT/JP2021/027392
§ 371 (c)(1),
(2) Date: Mar. 10, 2023

(87) PCT Pub. No.: WO2022/054425
PCT Pub. Date: Mar. 17, 2022

(65) Prior Publication Data

US 2023/0349664 A1 Nov. 2, 2023

(30) Foreign Application Priority Data

Sep. 14, 2020 (JP) ..... 2020-154017

(51) Int. Cl.
*F41B 6/00* (2006.01)
*F41H 13/00* (2006.01)

(52) U.S. Cl.
CPC ..... *F41B 6/00* (2013.01); *F41H 13/00* (2013.01)

(58) Field of Classification Search
CPC ..... F41B 6/00; F41H 13/00
USPC ..... 124/3
See application file for complete search history.

(56) References Cited

U.S. PATENT DOCUMENTS 2,373,364 A * 4/1945 Welleome ..... F42B 12/66 102/504
3,085,510 A * 4/1963 Campbell ..... F42B 7/04 102/456
3,803,463 A * 4/1974 Cover ..... F41B 15/00 361/232
4,664,034 A * 5/1987 Christian ..... F42B 12/66 102/439

(Continued)

FOREIGN PATENT DOCUMENTS

JP 83844 10/1929
JP 49-3189 1/1974

(Continued)

OTHER PUBLICATIONS

International Search Report issued in International Bureau of Wipo Patent Application No. PCT/ JP2021/027392, dated Aug. 31, 2021.

*Primary Examiner* — Samir Abdosh
(74) *Attorney, Agent, or Firm* — Greenblum & Bernstein, P.L.C.

(57) ABSTRACT

An object of the present invention is to provide a capture device enabling capture of a target to be captured without direction contact with the target to be captured.
A capture device for capturing a target with a wire includes: a casing that holds a cartridge detachably; and a launch unit that launches a wire stored in the cartridge, the wire having an end portion provided with a weight and another end portion provided with a weight, in which the launch unit launches the wire with a magnetic field generated by a flow of current through a coil.

6 Claims, 9 Drawing Sheets

(56) References Cited

U.S. PATENT DOCUMENTS

| | | | | | |
|---|---|---|---|---|---|
| 5,315,932 | A * | 5/1994 | Bertram | F41H 13/0006 | 102/504 |
| 5,326,101 | A * | 7/1994 | Fay | F41H 13/0006 | 463/47.4 |
| 5,750,918 | A * | 5/1998 | Mangolds | F42B 12/66 | 102/213 |
| 5,988,036 | A * | 11/1999 | Mangolds | F42B 12/66 | 102/502 |
| 8,857,305 | B1 * | 10/2014 | Tseng | F41B 15/10 | 124/71 |
| 9,989,336 | B2 * | 6/2018 | Purvis | F41H 13/0006 | |
| 11,674,778 | B1 * | 6/2023 | Borter | F41A 9/41 | 124/73 |
| 2007/0283834 | A1 * | 12/2007 | Chen | F41H 13/0025 | 102/502 |
| 2017/0276461 | A1 * | 9/2017 | Norris | F42B 5/03 | |
| 2018/0094908 | A1 * | 4/2018 | Down | F41G 3/06 | |
| 2018/0372456 | A1 * | 12/2018 | Norris | F41H 13/0006 | |

FOREIGN PATENT DOCUMENTS

| | | |
|---|---|---|
| JP | 6-101994 | 4/1992 |
| JP | 2000-513089 | 10/2000 |
| JP | 2004-326155 | 11/2004 |
| JP | 2014-6022 | 1/2014 |
| WO | 98/54538 | 12/1998 |

* cited by examiner

CAPTURE DEVICE

TECHNICAL FIELD

The present invention relates to a capture device using a wire.

BACKGROUND ART

A device has been conventionally studied that reliably captures a target to be restrained (e.g., a culprit on the run or an animal). Patent Literature 1 describes a proposed truncheon that is to be carried by a police officer and has a double-pipe structure in which a storage pipe storing a rope or net is loaded. The storage pipe serves as a cartridge integrated with launch means.

Patent Literature 2 describes a proposed system in which a portable launch device of a gun type launches a net to restrain a target. The portable launch device uses gunpowder for launching a net.

CITATION LIST

Patent Literature

Patent Literature 1: JP 2014-6022 A
Patent Literature 2: JP 2000-513089 A

SUMMARY OF INVENTION

Technical Problem

Regarding the truncheon described in Patent Literature 1, because the cartridge as the storage pipe is relatively long, carrying a spare cartridge is not practical. If a single time of launch results in failure of capture, another launch is difficult to make successively. Regarding the system described in Patent Literature 2, gunpowder is used for launching a net. Thus, from a viewpoint of legal restraints, countries or areas in which the system can be used are limited.

An object of the present invention is to provide a capture device enabling a user to capture a target to be captured without direct contact with the target to be captured.

Solution to Problem

According to the invention, the above problems are solved by any one of the following [1] to [6].

[1] A capture device for capturing a target with a wire, the capture device comprising a casing that holds a cartridge detachably; and a launch unit that launches a wire stored in the cartridge, the wire having an end portion provided with a weight and another end portion provided with a weight, wherein the launch unit launches the wire with a magnetic field generated by a flow of current through a coil;

[2] The capture device according to the above [1], further comprising: a plurality of the coils, wherein the magnetic field is generated by a flow of current based on application of voltage in order from a rear coil to a front coil in the plurality of the coils;

[3] The capture device according to the above [1] or [2], further comprising: a lever; a trigger; and a circuit capable of applying voltage to the coil, wherein the capture device is of a pistol type, the lever serves as a switch that controls charge and discharge to the circuit capable of applying voltage to the coil, and the trigger serves as a switch that controls a start of application of voltage to the coil;

[4] The capture device according to any of the above [1] to [3], wherein the cartridge has a locking mechanism, and the cartridge is held by the casing based on temporary securement due to the locking mechanism;

[5] The capture device according to any of the above [1] to [4], wherein the plurality of the coils are each a solenoid coil, and the plurality of the coils is disposed such that respective axial directions of the coils are identical to a launch direction of the wire;

[6] The capture device according to any of the above [1] to [5], further comprising a supply unit that supplies the cartridge.

Advantageous Effects of Invention

According to the present invention, provided can be a capture device enabling a user to capture a target to be captured without direct contact with the target to be captured.

DESCRIPTION OF EMBODIMENTS

Figure 1A:
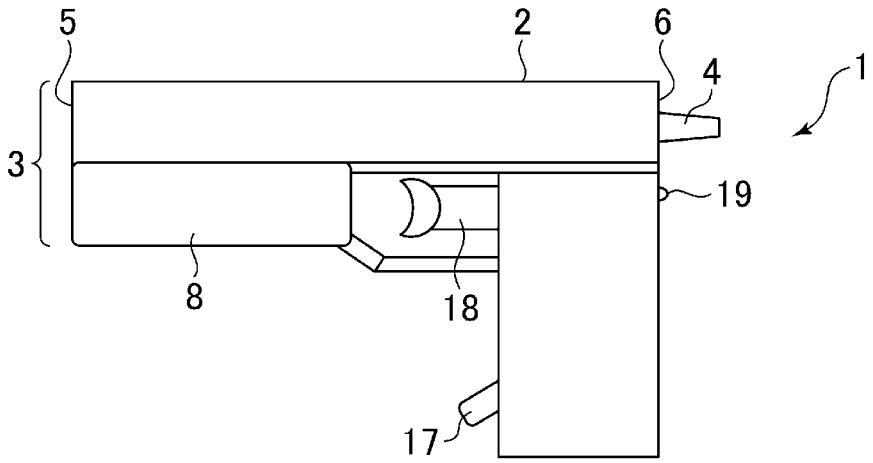
FIGS. 1A and 1B illustrate schematic views of a capture device, corresponding to at least one of the embodiments of the present invention.

Embodiments of the present invention will be described below with reference to the accompanying drawings. The following description regarding effects correspond to an aspect of the effects of an embodiment of the present invention, and thus is not limiting.

(Capture Device)

An overview of a capture device according to the present invention will be described. FIG. 1 illustrates schematic views of a capture device, corresponding to at least one of the embodiments of the present invention. The capture device 1 is a capture device used for capturing a target with a wire. The capture device 1 includes at least a casing 2 that holds a cartridge detachably and a launch unit 3 that launches the wire. FIG. 2 is a schematic view of the capture device, corresponding to at least one of the embodiments of the present invention, and is a top view of the capture device illustrated in FIG. 1. For easy understanding of the configuration of the launch unit 3, FIGS. 1B and 2 illustrate the portion of the launch unit 3 in the casing 2 in a see-through manner.

Note that, in the present specification, the sides of locations of an outlet 5 and a cartridge inlet 6 that the capture device 1 has are defined as front and rear, respectively.

From viewpoints of portability and operability, preferably, the capture device 1 has a shape graspable one-handed. Referring to FIG. 1, as an exemplary embodiment of the present invention, a pistol type of capture device is provided.

From viewpoints of portability and one-handed grasping, preferably, the casing 2 of the capture device 1 is formed of a metallic material, such as stainless steel, aluminum, titanium, aluminum alloy, or titanium alloy, or a resin material, such as polycarbonate. From a viewpoint of ejection of the wire due to magnetic force as described below, preferably, the casing 2 is formed of a resin material, such as polycarbonate.

The casing 2 holds detachably a cartridge 4 storing the wire for capturing a target. Specifically, for example, the cartridge 4 is inserted to a predetermined position in the casing 2 through the cartridge inlet 6 on the rear side of the casing 2, so that the cartridge 4 is held by the casing 2. Pulling out the cartridge 4 through the cartridge inlet 6 enables detachment of the cartridge 4 from the casing 2. The casing 2 may have a locking mechanism, to be described below, structurally such that, in response to insertion of the cartridge 4 to the predetermined position in the casing 2, the cartridge 4 is prevented from moving from the predetermined position to both of the side of location of the inlet 6 and the side of location of the outlet 5.

The launch unit 3 ejects, due to magnetic force, a wire 14 for capturing a target, to be described below. As described below, the launch unit 3 includes one or a plurality of coils 7. The number of coils 7 is not particularly limited. The launch unit 3 is provided with a path 27 extending from rear to front. Weights 15 and 16, to be described below, provided, respectively, at one end and the other end of the wire 14 are ejected from the outlet 5 through the path 27. The launch unit includes, inside, a barrel having a space of which the cross section is longer in the lateral direction than in the height direction. The internal space is used as the path 27 for the wire 14 and the weights 15 and 16. A coil 7 is wound around the outside of the barrel such that the axial direction of the coil 7 and the launch direction of the wire (longitudinal direction of the path 27) are identical. Application of voltage in the order from the rear coil 7 to the front coil 7 in the plurality of coils 7 generates a magnetic field from the rear to front of the casing 2. For example, the weights 15 and 16 are made of a ferromagnetic material, such as iron, cobalt, or nickel, or a paramagnetic material, such as aluminum, titanium, or zirconium. The weights 15 and 16 present in a magnetic field generated by a flow of current through the coil 7 accelerate while moving from the rear side to front side of the path 27 due to the effect of magnetic force. The weights 15 and 16 are ejected due to magnetic force.

Note that the path 27 inside the barrel may have a width increasing from rear to front. The wire 14 and the weights 15 and 16 can spread laterally while moving forward. In order to capture a subject to be captured, the weights 15 and 16 are required to spread laterally. Adoption of such a configuration in which the path 27 has a lateral width increasing from rear to front enables facilitation of lateral spread of the weights 15 and 16 at the time of ejection of the wire 14 and the weights 15 and 16 from the outlet 5.

The launch unit 3 of the capture device illustrated in FIG. 1B includes three coils 7 (coils 7*a*, 7*b*, and 7*c*). The three coils 7 are arrayed from front to rear. The coils 7*a* to 7*c* are each an air-core solenoid coil and are connected to a voltage generation unit 8 such that voltage can be applied to the coils 7*a* to 7*c*. Referring to FIG. 1, the number of coils is three. However, more numerous coils may be provided, such as four coils, five coils, or six coils. In terms of portability of the capture device, the number of coils 7 may be 10 or less.

The coils 7 can be each appropriately designed in terms of the length in the front-rear direction, the number of turns, the number of turns per unit length, the shape of a cross section orthogonal to the front-rear direction of the coil, the area of the cross section, the diameter of the lead of the coil, or the material of the lead. The coils 7 may be identical to or different from each other in terms of the length in the front-rear direction, the number of turns, the number of turns per unit length, the shape of a cross section orthogonal to the front-rear direction of the coil, the area of the cross section, the diameter of the lead of the coil, or the material of the lead. A change can be made in the intensity of current that flows through each coil 7. A larger flow of current through a coil 7 causes generation of a larger intensity of magnetic field. For example, a larger flow of current through a coil 7 closer to the front than a flow of current through a coil 7 closer to the rear causes a larger intensity of magnetic field on the front side. Thus, the weights 15 and 16 can accelerate easily as move forward.

Figure 3:
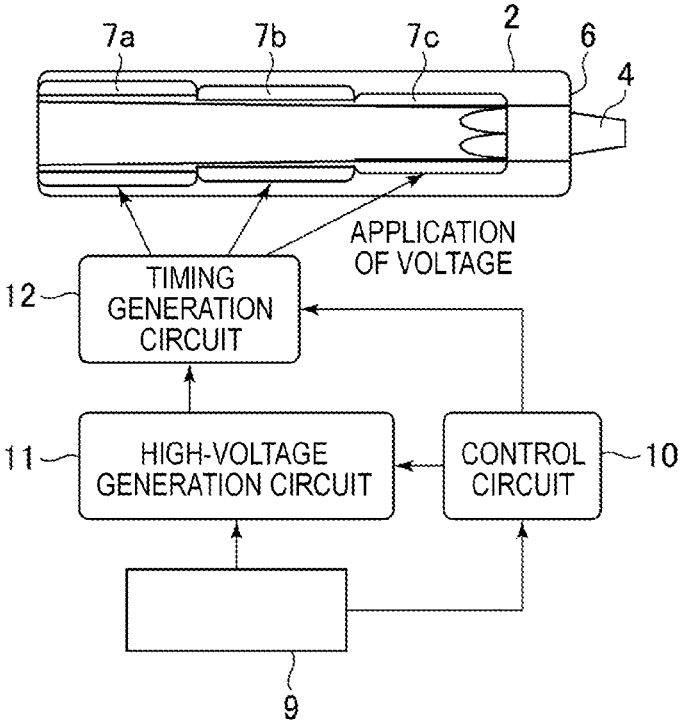
FIG. 3 is a schematic diagram for describing a configuration of a launch unit of a capture device, corresponding to at least one of the embodiments of the present invention.

FIG. 3 is a schematic diagram for describing the configuration of the launch unit of the capture device, corresponding to at least one of the embodiments of the present invention. The voltage generation unit 8 of the launch unit 3 includes a control circuit 10, a high-voltage generation circuit 11, and a timing generation circuit 12. The control circuit 10, the high-voltage generation circuit 11, and the timing generation circuit 12 may be electrically connected to a battery 9. Then, the battery 9 may function as a power source for the circuits. The control circuit 10 controls the high-voltage generation circuit 11 and the timing generation circuit 12.

The high-voltage generation circuit 11 raises the voltage supplied from the battery 9, so that a higher voltage can be generated. The timing generation circuit 12 applies the voltage generated by the high-voltage generation circuit 11 to a coil and specifies the timing for stopping the application for control.

FIG. 1B illustrates an exemplary form in which the capture device 1 of a pistol type includes: a grip 13 equipped with the battery 9; and the voltage generation unit 8 including the control circuit 10, the high-voltage generation circuit 11, and the timing generation circuit 12, just under the casing 2.

Figure 4A:
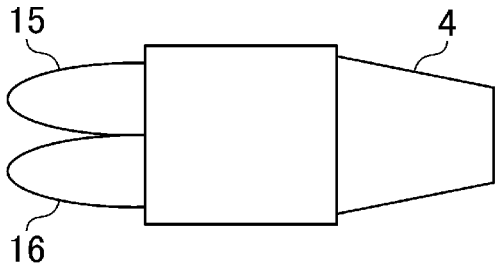
FIGS. 4A-4C illustrate schematic views of a cartridge, corresponding to at least one of the embodiments of the present invention.
Figure 4B:
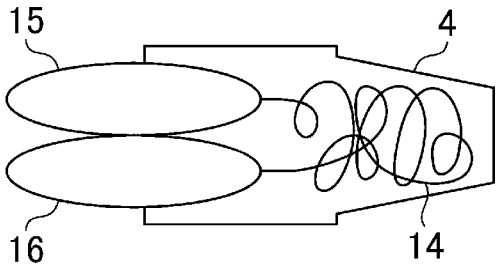
Figure 4C:
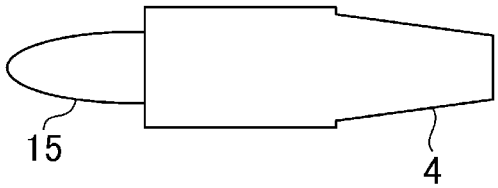

FIG. 4 illustrates schematic views of the cartridge, corresponding to at least one of the embodiments of the present invention. FIG. 4A is a top view of the external appearance of the cartridge. FIG. 4B is a sectional view taken along a plane orthogonal to the height direction of the cartridge, including the center in the height direction of the cartridge. FIG. 4C is a side view of the external appearance of the cartridge. The cartridge 4 stores the wire 14 for capturing a target. Preferably, the main body of the cartridge 4 is formed of a material resistant to the influence of a magnetic field. For example, a material such as plastic can be adopted.

As the wire 14, used can be a wire made of fiber, such as polyamide-imide fiber, polyimide fiber, or ultra-high-molecular-weight polyethylene. The total length of the wire 14 is sufficient for capturing a target. For example, the total length of the wire 14 is preferably 2 m or more, more preferably, 2.3 m or more. The total length of the wire 14 is preferably 3 m or less, more preferably, 2.7 m or less. For example, the diameter of the wire 14 is preferably 0.3 mm or more, more preferably, 0.5 mm or more. The diameter of the wire is preferably 3 mm or less, more preferably, 2 mm or less.

The wire 14 has one end portion and the other end portion provided with the weights 15 and 16, respectively. As the material of the weights 15 and 16, for reception of magnetic force from a solenoid coil, a metal, such as a ferromagnetic material or a paramagnetic material, or a resin having its surface covered with such a metal can be adopted. For each weight, mass can be appropriately selected based on the material for use as the weight. The mass of the weight is preferably 1 g or more, more preferably, 2 g or more, further preferably, 3 g or more. The mass of the weight is preferably 6 g or less, more preferably, 5 g or less, further preferably, 4 g or less.

Preferably, the weights 15 and 16 each have a longitudinally long shape, such as a cuboid shape or a columnar shape. The weights 15 and 16 longitudinally long in shape are stored in the cartridge 4 such that the longitudinal directions of the weights 15 and 16 are identical to the direction of ejection. Thus, in a case where the weights 15 and 16 are ejected, the longitudinal directions of the weights 15 and 16 and the direction of ejection are identical, leading to a reduction in the air resistance of the weights 15 and 16. From a viewpoint of ejection distance, as a cuboid shape, preferably, the weights 15 and 16 each measure 0.3 to 1 cm in depth, 0.3 to 1 cm in width, and 1 to 4 cm in height. As a columnar shape, preferably, the weights 15 and 16 each measure 3 to 10 mm in diameter and 10 to 40 mm in length.

With the cartridge 4 inserted in the casing 2, the front of the cartridge is closer to the outlet 5 and the rear of the cartridge is further away from the outlet 5. In the cartridge 4, the weights 15 and 16 are stored at the front of the cartridge 4 and the wire 14 is stored at the rear of the cartridge 4. The weights 15 and 16 are each stored at a position such that at least part of the front of the weight is exposed outward from the outlet side of the cartridge. Since the weights 15 and 16 are stored at such positions, the weights 15 and 16 get out of the cartridge due to magnetic force from the launch unit 3, so that the weights 15 and 16 can move to the side of location of the outlet 5 of the casing 2.

Preferably, the cartridge 4 have a locking mechanism. The locking mechanism can be achieved, for example, with a lock pin or a ball lock pin.

Figure 1B:
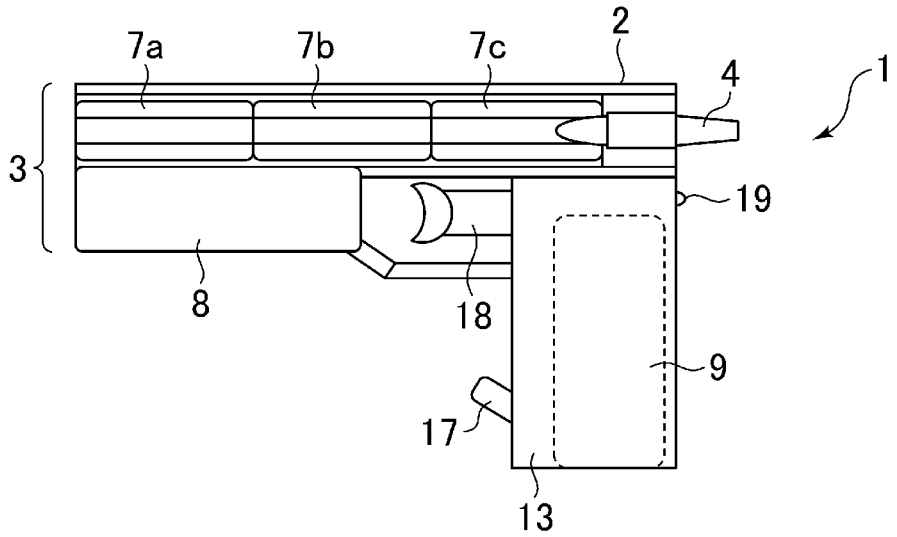
Figure 2:
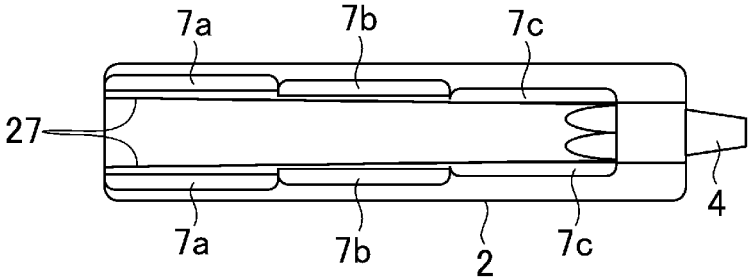
FIG. 2 is a schematic view of a capture device, corresponding to at least one of the embodiments of the present invention.

As illustrated in FIG. 1, the casing 2 includes a safety lever 17. The safety lever 17 has a function of switching the battery 9 between on and off in power. Lowering the safety lever 17, namely, moving the safety lever 17 in the direction away from the casing 2 (refer to FIG. 1A) switches the battery 9 on in power, so that charging starts to the high-voltage generation circuit 11. In contrast, raising the safety lever 17 (refer to FIG. 1B), namely, moving the safety lever 17 to the side of location of the casing 2 can switch the battery 9 off in power. With the safety lever 17 raised, a trigger 18 is disabled. Such a configuration enables prevention of accidental ejection in carrying.

(Operation and Manipulation of Capture Device)

An exemplary procedure of manipulation of the capture device will be described below with reference to FIGS. 1 and 3. First, the cartridge 4 is inserted into the casing 2 of the capture device through the cartridge inlet 6, and then the cartridge 4 is held by the casing 2 due to the locking mechanism.

The safety lever 17 is lowered such that the battery 9 is on in power. Then, the high-voltage generation circuit 11 inside the capture device is charged. In response to completion of the charging, preferably, an indicator 19 for verification of charge completion lights up.

When the trigger 18 is pulled to the opposite side to the outlet 5 of the casing 2 after the indicator 19 lights up, the control circuit 10 causes the timing generation circuit 12 to apply, to each coil in order, the voltage generated by the high-voltage generation circuit 11. The timing enables successive application of voltage with a time lag between each coil. The timing can be automatically calculated such that an error in the intensity of a magnetic field in each coil is absorbed for no error. The intensity of voltage to be applied and the period of time of application of voltage can be appropriately adjusted based on magnetic-force data measured by a magnetic sensor. Such application of voltage with a time lag between each coil as above causes each coil in order to generate a magnetic field, so that the weights 15 and 16 in the cartridge move while accelerating from the cartridge inlet 6 to the outlet 5 of the casing 2.

Figure 5A:
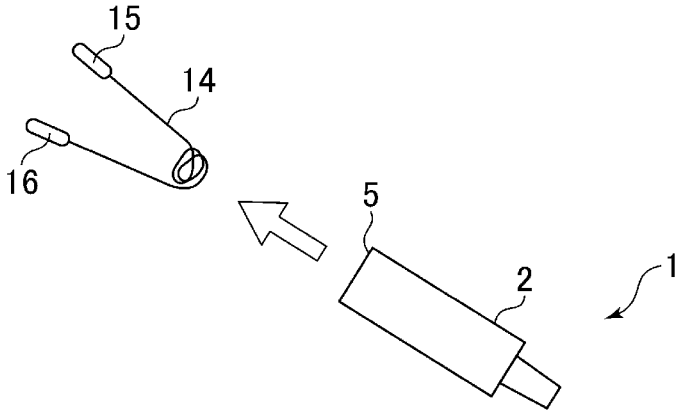
FIGS. 5A-5C illustrate schematic views for describing capture of a target with the capture device, corresponding to at least one of the embodiments of the present invention.
Figure 5B:
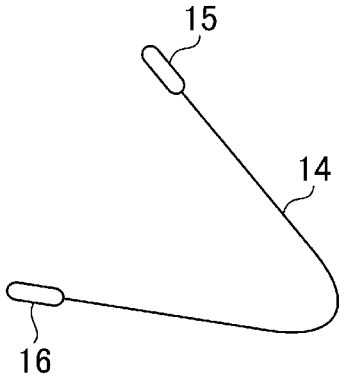
Figure 5C:
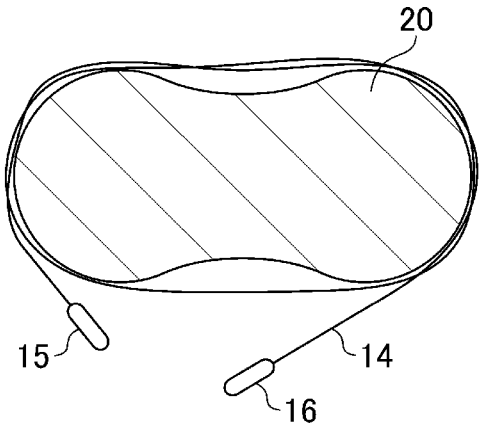

FIG. 5 illustrates schematic views for describing capture of a target with the capture device, corresponding to at least one of the embodiments of the present invention. Due to the manipulation, the weights 15 and 16 move to the side of location of the outlet 5 with the wire 14 pulled by the weights 15 and 16. As illustrated in FIG. 5A, the weights 15 and 16 and the wire 14 are ejected outward from the casing 2 through the outlet 5. As illustrated in FIG. 5B, with the weights 15 and 16 located ahead in the direction of the target, the ejected wire 14 flies while the wire folded in the cartridge is expanding. The weights 15 and 16 and the wire 14 fly while the interval between the weights is gradually widening. After a target 20 to be captured is interposed between the two weights 15 and 16, the wire 14 comes in contact with the target. Then, as illustrated in FIG. 5C, the wire 14 winds around the target 20, so that the target 20 can be captured.

After the wire 14 is launched, the cartridge 4 held in the capture device 1 is empty. Due to release of the locking mechanism, the empty cartridge 4 can be detached from the casing 2 of the capture device 1 through the cartridge inlet 6. After that, a new cartridge 4 storing a wire 14 and weights 15 and 16 is inserted through the cartridge inlet 6, so that the new cartridge 4 can be held in the capture device 1. Such a series of manipulations enables successive ejection of the wires in a short time.

(Additional Constituent for Capture Device: Supply Unit)

Figure 6A:
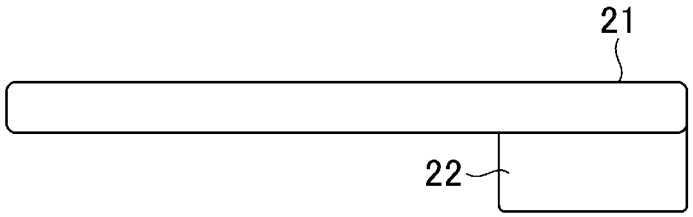
FIGS. 6A-6C illustrate schematic views of a cartridge supply unit, corresponding to at least one of the embodiments of the present invention.
Figure 6B:
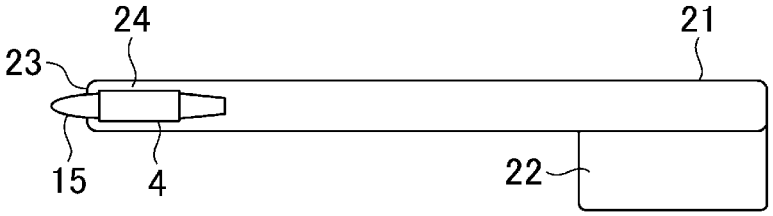
Figure 6C:
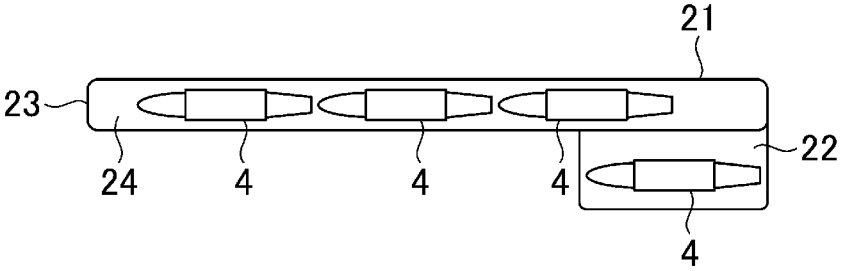
Figure 7A:
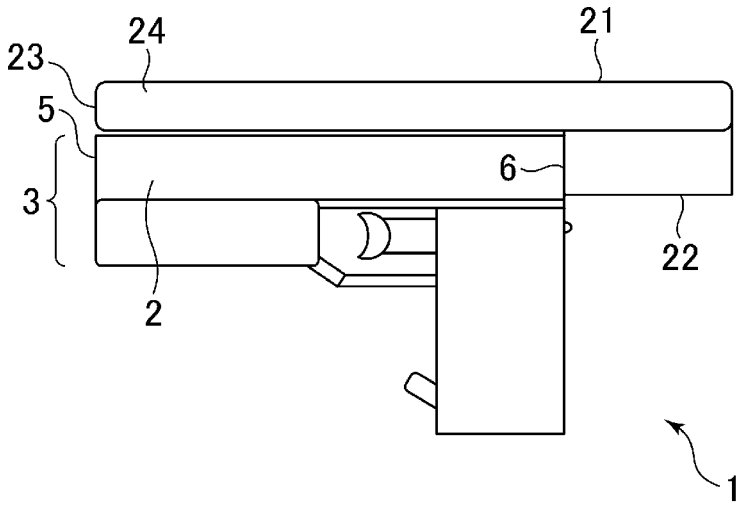
FIGS. 7A and 7B illustrate schematic views for describing supply of a cartridge to the capture device with the supply unit, corresponding to at least one of the embodiments of the present invention.

FIG. 6 illustrates schematic views of a cartridge supply unit, corresponding to at least one of the embodiments of the present invention. The cartridge supply unit 21 can store a plurality of cartridges. As illustrated in FIG. 6A, the supply unit 21 has a lower portion provided with a supplier 22 that supplies a cartridge to the cartridge inlet 6. As illustrated in FIG. 7A, to be described below, the supply unit 21 is provided at the upper portion of the casing 2 of the capture device 1 such that the supplier 22 covers the cartridge inlet 6.

Preferably, the supply unit 21 and the supplier 22 are each formed of a material resistant to the influence of magnetic force. For example, a material such as plastic can be adopted.

The supply unit 21 has an opening 23 for loading a cartridge 4 at its leading end closer to the outlet 5 of the capture device 1 with the supply unit 21 provided at the upper portion of the casing 2 of the capture device 1. Hereinafter, the side of location of the opening 23 of the supply unit 21 is defined as the front of the supply unit 21. The side opposite to the front in the longitudinal direction of the supply unit 21 is defined as the rear of the supply unit 21. FIG. 6B illustrates a state where a cartridge 4 is loaded into the supply unit 21 through the opening 23. The supply unit 21 can store a plurality of cartridges 4. Inside the supply unit 21, a cartridge 4 is movable forward and backward in the longitudinal direction of the supply unit 21. Each cartridge 4 stores a wire 14 having one end and the other end provided with weights 15 and 16, respectively.

For storage of a plurality of cartridges, cartridges 4 are loaded successively through the opening 23. FIG. 6C illustrates an exemplary form in which three cartridges 4 are stored in the main portion of the supply unit 21 and one cartridge is stored in the supplier 22. In order to prevent a cartridge 4 from moving out of the supply unit 21 through the opening 23, preferably, for example, a stopper 24 is provided on the side of location of the opening 23. The provision of the stopper 24 enables prevention of a cartridge 4 from moving out of the side of location of the opening 23.

Figure 7B:
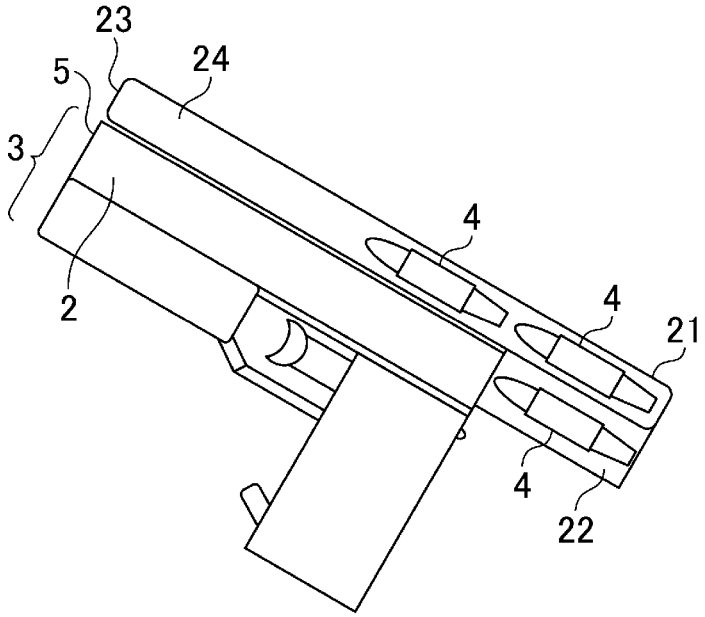

Supply of a cartridge to the capture device with the supply unit will be described below. FIG. 7 illustrates schematic views for describing supply of a cartridge to the capture device with the supply unit, corresponding to at least one of the embodiments of the present invention. FIG. 7B illustrates, for easy understanding of the configuration of the supply unit 21 and the supplier 22, the supply unit 21 and the supplier 22 in a see-through manner.

As illustrated in FIG. 7A, the supply unit 21 is provided at the upper portion of the casing 2 of the capture device 1 such that the supplier 22 covers the cartridge inlet 6. The supply unit 21 may be provided at the upper portion of the casing 2 of the capture device 1 by forward sliding of the supply unit 21 along the upper portion of the casing 2. The supply unit 21 provided at the upper portion of the capture device 1 may be temporarily disabled from being detached from the capture device 1. As a method of temporarily disabling the supply unit 21 from being detached from the capture device 1, a publicly known method can be adopted. For example, a projection provided at the supply unit 21 may be fitted into a hole provided at the upper portion of the casing 2 of the capture device 1 such that the supply unit 21 is temporarily disabled from being detached from the capture device 1.

For supply of a cartridge 4 to the capture device 1, the cartridge 4 is loaded through the supply port 23 with the capture device 1 provided with the supply unit 21. Every time one cartridge 4 is loaded, as illustrated in FIG. 7B, the capture device is slanted such that the front of the capture device 1 is higher in level than the rear of the capture device 1. Thus, the cartridge 4 in the supply unit 21 can move, due to its weight, to the rear of the capture device 1.

The supply unit 21 and the supplier 22 are connected through an internal communicating space. Thus, after moving to the rear of the capture device 1, the cartridge 4 is stored in the supplier 22. Alternatively, the cartridge 4 present above the supplier 22 may be stored in the supplier 22 by depression to the supplier 22. The cartridge 4 stored in the supplier 22 is inserted into the casing 2 through the cartridge inlet 6, so that the cartridge 4 is held by the casing. Due to such a locking mechanism as described above, the cartridge 4 inserted in the casing 2 may be prevented from moving from the predetermined position.

The empty cartridge 4 after the wire and the weights are ejected from the capture device can be detached through the cartridge inlet 6. After that, as illustrated in FIG. 7B, the capture device is slanted again that such that the front of the capture device 1 is higher in level than the rear of the capture device 1. Thus, a cartridge 4 can be moved to the supplier 22. Such manipulations enable successive ejection of the wires, leading to an enhancement in capture efficiency.

(Additional Constituent for Capture Device: Belt Hook)

Figure 8:
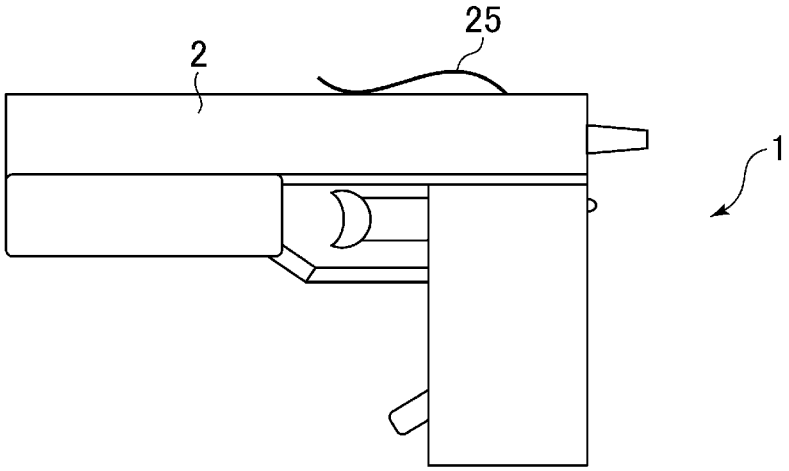
FIG. 8 is a schematic view of a capture device, corresponding to at least one of the embodiments of the present invention.
Figure 9A:
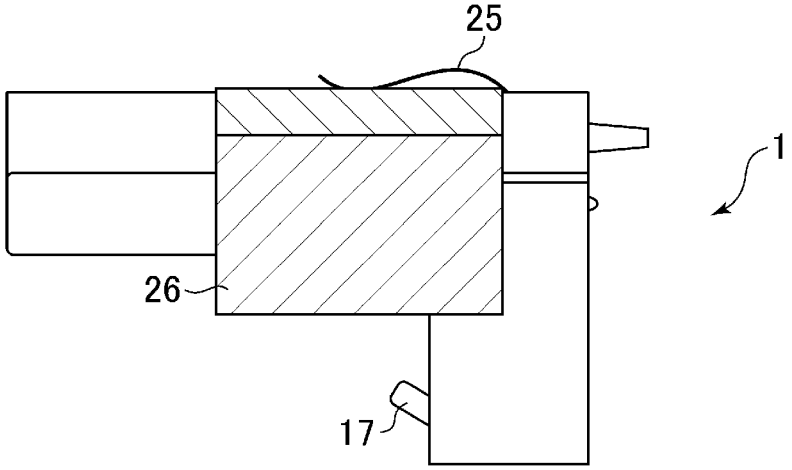
FIGS. 9A and 9B illustrate schematic views of the capture device provided with a cover, corresponding to at least one of the embodiments of the present invention.
Figure 9B:
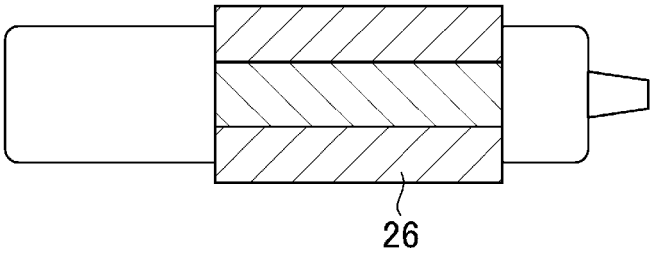

FIG. 8 is a schematic view of a capture device, corresponding to at least one of the embodiments of the present invention. FIG. 9 illustrates schematic views of the capture device provided with a cover, corresponding to at least one of the embodiments of the present invention. The capture device 1 according to the present invention may be provided with such a belt hook 25 as illustrated in FIG. 8 for movement with the capture device 1 secured to a belt or the like in carrying. As illustrated in FIG. 9A and FIG. 9B that is a top view based on FIG. 9A, the capture device 1 can be protected with a cover 26 with no interference with loading of a cartridge, taking out of a cartridge, or manipulation of the safety lever 17 or the trigger.

The capture device according to the present invention has a structure enabling launching of the wire with magnetic force and requiring no bursting powder, and thus can be used in Japan. The capture device according to the present invention is applicable to not only capture of a person but also catching of a small animal that ruins a field or the like.

REFERENCE SIGNS LIST

1 Capture device
2 Casing
3 Launch unit
4 Cartridge
5 Outlet
6 Inlet
7 Coil
8 Voltage generation unit
9 Battery
10 Control circuit
11 High-voltage generation circuit
12 Timing generation circuit
13 Grip
14 Wire
15, 16 Weight
17 Safety lever
18 Trigger
19 Indicator
20 Target
21 Supply unit
22 Supplier
23 Opening (Supply port)
24 Stopper
25 Belt hook
26 Cover
27 Path

The invention claimed is:

1. A capture device for capturing a target with a wire, the capture device comprising:

a casing that holds a cartridge detachably; and a launch unit that launches a wire stored in the cartridge, the wire having an end portion provided with a weight and another end portion provided with a weight, wherein the launch unit launches the wire with a magnetic field generated by a flow of current through at least one coil.

2. The capture device according to claim 1, wherein
at least one coil is a plurality of coils, and
the magnetic field is generated by the flow of current based on application of voltage in order from a rear coil to a front coil in the plurality of coils.

3. The capture device according to claim 1, further comprising:
a lever;
a trigger, and
a circuit capable of applying voltage to the coil, wherein
the capture device is of a pistol type,
the lever serves as a switch that controls charge and discharge to the circuit capable of applying voltage to the coil, and
the trigger serves as a switch that controls a start of application of voltage to the coil.

4. The capture device according to claim 1, wherein
the cartridge has a locking mechanism, and
the cartridge is held by the casing based on temporary securement due to the locking mechanism.

5. The capture device according to claim 2, wherein
each coil of the plurality of coils is a solenoid coil, and
each coil of the plurality of coils is disposed such that a respective axial direction of each coil is identical to a launch direction of the wire.

6. The capture device according to claim 1, further comprising a supply unit that supplies the cartridge.

* * * * *